US005549779A

United States Patent [19]

Stoecklein

[11] Patent Number: 5,549,779

[45] Date of Patent: Aug. 27, 1996

[54] PROCESS FOR THE PRODUCTION OF A PENCIL

[75] Inventor: Thomas Stoecklein, Nuremberg, Germany

[73] Assignee: Schwan-Stabilo Schwanhaeusser GmbH & Co., Nuremberg, Germany

[21] Appl. No.: 182,138

[22] PCT Filed: Jul. 16, 1992

[86] PCT No.: PCT/EP92/01621

§ 371 Date: Apr. 7, 1994

§ 102(e) Date: Apr. 7, 1994

[87] PCT Pub. No.: WO93/01944

PCT Pub. Date: Feb. 4, 1993

[30] Foreign Application Priority Data

Jul. 20, 1991 [DE] Germany ..... 41 24 210.6

[51] Int. Cl.[6] ..... B43K 19/02

[52] U.S. Cl. ..... 156/293; 156/306.6; 401/96

[58] Field of Search ..... 144/346, 348, 144/352; 401/96; 156/293, 294, 306.6

[56] References Cited

U.S. PATENT DOCUMENTS

| | | | |
|---|---|---|---|
| 1,892,508 | 12/1932 | Gonzalez | 401/96 |
| 2,098,452 | 11/1937 | Herstein | 401/96 |
| 2,319,585 | 5/1943 | Chesler . | |
| 5,244,297 | 9/1993 | Bachelet et al. | 401/96 |

FOREIGN PATENT DOCUMENTS

| | | | |
|---|---|---|---|
| 781976 | 5/1935 | France . | |
| 0969976 | 12/1950 | France | 401/96 |
| 2504103 | 11/1975 | Germany . | |
| 2265723 | 5/1985 | Germany . | |
| 0471340 | 9/1937 | United Kingdom . | |

OTHER PUBLICATIONS

Article "Microwave Press–Setting Equipment For Pencil Manufacture" from the *Journal of Microwave Power*, vol. 10, No. 1, pp. 19–26, Mar., 1975.

*Primary Examiner*—Michael W. Ball
*Assistant Examiner*—Sam Chuan Yao
*Attorney, Agent, or Firm*—Bachman & LaPointe, P.C.

[57] ABSTRACT

A process for the production of a pencil comprising the steps of introducing one of a lead and a core stick into a groove in a first housing portion; applying a second housing portion having a groove to the first housing portion wherein the groove of the second housing portion is fitted with one of said lead and said core stick; gluing one of said lead and said core stick to the first and second housing portions; and gluing the first and second housing portions together; wherein the step of gluing one of said lead and said core stick is achieved through using an adhesive comprising one of a flexible fusion adhesive and melt adhesive, the adhesive having outside dimensions lying within close dimensional tolerances with respect to the dimensions of the grooves of the first and second housing such that the core stick is closely fixed between the first and second housing portions.

6 Claims, 1 Drawing Sheet

PROCESS FOR THE PRODUCTION OF A PENCIL

BACKGROUND OF THE INVENTION

The invention relates to a process for the production of a pencil, wherein a lead or core stick is introduced into a groove in a first housing portion and then a second housing portion provided with a groove is applied to the first housing portion with the lead or core stick and the lead or core stick is glued to the housing portions and the two housing portions are glued to each other.

The so-called 'bonding process' is known for the production of a pencil, wherein an adhesive is applied to the lead or core stick at a plurality of locations in an annular configuration or in a network-like structure. The bonding process therefore serves for fixing the lead or core stick in the groove in a first housing portion and for fixing the lead or core stick between the two housing portions which are provided with corresponding grooves. That process suffers from the disadvantage that it is only possible with difficulty to apply an adhesive to a lead or core stick in the specified manner, that is to say using the bonding procedure.

It is also known for finished leads or core sticks to be coated with a hard, that is to say inflexible layer of lacquer or plastic material in order to increase the breaking strength of the leads or core sticks. The same process, that is to say coating finished leads with a hard inflexible layer of lacquer or plastic material for increasing the breaking strength, is used for example, in relation to leads or core sticks with water-soluble dyes, as are used for example in so-called indelible pencils, or in relation to emulsifier-bearing pigmented textures, as are used for example in so-called water-paintable pencils, in order to prevent diffusion of the dye or constituents of a water-soluble pigment into the wood of the housing portions during the operation of glueing the leads or core sticks between the housing portions.

In the case of water-based compositions for leads or core sticks, it was previously necessary to produce leads or core sticks from each composition batch, as samples thereof, and to dry same, in order to detect and take account of or compensate for the shrinkage of the sample leads or core sticks, which is caused by the drying operation and which varies in dependence on the composition used. That not only involves a considerable amount of time but also constitutes an uncertainty factor in the production of such leads or core sticks. In addition, in the operations of cutting and applying the extruded lead or core stick portion, it is not possible reliably to exclude elongation or upsetting of the leads or core sticks, which can result in fluctuations in the thickness of the leads or core sticks. Besides those tolerances in regard to the leads or core sticks, the grooves in the housing portions my also have certain tolerances, that is to say for example they may be of different depths, which can result in difficulties when the leads or core sticks are being glued into position in the grooves, that is to say between the two housing portions.

SUMMARY OF THE INVENTION

The object of the present invention is that of providing a process of the kind set forth in the opening part of this specification, with which the above-mentioned problems are eliminated, that is to say with which in particular tolerances in respect of the leads or core sticks and tolerances in respect of the grooves in the housing portions can be easily compensated so that said pencils can be produced at a high level of productivity with a low degree of manufacturing wastage.

The objects of the present invention are achieved by the process disclosed herein for the production of a pencil comprising the steps of introducing one of a lead and a core stick into a groove in a first housing portion; applying a second housing portion having a groove to the first housing portion wherein the groove of the second housing portion is fitted with one of said lead and said core stick; gluing one of said lead and said core stick to the first and second housing portions; and gluing the first and second housing portions together; wherein the step of gluing one of said lead and said core stick is achieved through using an adhesive comprising one of a flexible fusion adhesive and a melt adhesive, the adhesive having outside dimensions lying within close dimensional tolerances with respect to the dimensions of the grooves of the first and second housing such that the core stick is clearly fixed between the first and second housing portions.

DETAILED DESCRIPTION OF THE PREFERRED EMBODIMENT

Figure 1A:
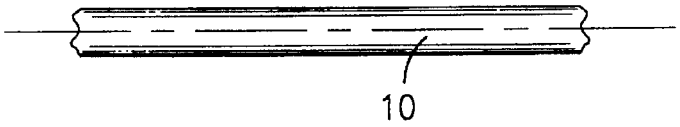
FIG. 1A is a partial enlarged view of a lead or core stick used for producing a pencil in accordance with the process of the present invention.

In accordance with the invention, that object is attained in that a layer of a flexible fusion or melt adhesion is applied to the lead or core stick, the outside dimensions of which layer lie within close dimensional tolerances, and that the lead or core stick is then introduced into the groove in the first housing portion or fixed between the two housing portions.

By virtue of the flexibly yielding layer of fusion or melt adhesive, it is possible to compensate for production tolerances in respect of the leads or core sticks, as are caused for example by drying shrinkage or due to elongation or upsetting, and also dimensional tolerances in respect of the grooves in the housing portions, which serve to receive the leads or core sticks, so that the leads or core sticks can be fixed between the housing portions without any problem, that is to say, with a low level of manufacturing wastage. By means of the flexible adhesive the leads or core sticks can be clamped in position between the associated housing portions, without the leads or core sticks suffering from damage. The flexible fusion or melt adhesive therefore guarantees an accarate fit for each lead or core stick in the groove in the corresponding housing portion. It is even possible to compensate for grooves of a non-round cross-sectional profile, by means of the flexible fusion or melt adhesive. The presence of the flexible fusion or melt adhesive means that it is possible to omit the application of glue in the grooves, which is otherwise usually employed, and that means that the residual moisture content of the pencils is dependent only on the amount of glue used for glueing the housing portions together, and is thus comparatively low. As a result of that comparatively low level of residual moisture, it is advantageously possible to omit a time-consuming operation of post-drying of the pencils, so that the production times are considerably reduced. Further advantages of the process according to the invention are that the flexible layer of fusion or melt adhesive gives leads or core sticks with water-soluble dyes or leads or core sticks comprising pigmented formulations with an emulsifier additive, protection from so-called bleeding-out, that is to say diffusion of the dye of the leads or core sticks into the wood of the housing portions, the leads or core sticks are protected by the fusion or melt adhesive from the penetration of moisture thereinto from the glue in the glueing operation so that irreparable alterations in the quality of the leads or core sticks are prevented, and that the life of the points of the leads or core sticks and the sharpenability and in particular manual sharpenability of the leads or core sticks of the pencils produced according to the invention are improved. In addition the emission of solvent vapours is avoided so that it is possible to eliminate expensive suction removal apparatuses, as are used for example when applying lacquer to leads or core sticks. A major advantage of the process according to the invention is considered to lie in its environmentally friendly nature.

In accordance with the invention, it is possible for the lead or core stick to be introduced into a bath of the fusion or melt adhesive, in which the lead or core stick is covered with a layer of the adhesive, and for the lead or core stick covered with the adhesive then to be moved through a calibration nozzle. Excess adhesive is removed from the lead or core stick by means of the calibration nozzle, thus giving precisely defined conditions in regard to the outside dimensions of the leads or core sticks which are covered with the adhesive. That is a matter of importance in regard to mass production with its tolerance factors.

When carrying out the process according to the invention, the steps of introducing the lead or core stick into the bath of the hot fusion or melt adhesive and moving the lead or core stick which is covered with the adhesive through the calibration nozzle can be separate from each other. However a high level of productivity is achieved if the lead or core stick is moved through the bath of the fusion or melt adhesive and immediately thereafter through the calibration nozzle. For that purpose the wall of the bath container for the hot fusion or melt adhesive may be provided with at least one suitable calibration nozzle.

The fusion or melt adhesive may be applied to the lead or core stick upstream of the calibration nozzle and the lead or core stick which is covered with the adhesive can be simultaneously moved through the calibration nozzle. That process can be carried out by means of the above-mentioned fusion adhesive bath, but it is also possible for the fusion or melt adhesive to be applied to the lead or core stick upstream of the calibration nozzle by being painted thereon, sprayed thereon, rolled thereon or the like, and for the lead or core stick which is covered with the fusion or melt adhesive then to be moved simultaneously through the calibration nozzle in order to provide defined conditions in reward to the adhesive.

A process which saves a great deal of time provides that the lead or core stick is fixed between the two housing portions by means of microwave radiation. Microwave radiation can be used in particular when a dispersion adhesive is used for glueing the housing portions and when a certain residual moisture content is present in the wood of the housing portions or so-called boards for a plurality of leads or core sticks. While a period of the order of magnitude of eight hours is required for the drying operation when using a so-called groove glue, when the above-mentioned fusion or melt adhesive is employed it is possible to cause the microwave radiation to act only for a few seconds in order to produce the corresponding mechanically strong join.

Further details, features and advantages will be apparent from the following description of successive working steps of the process according to the invention, which are diagrammatically indicated in the drawing.

Figure 1B:
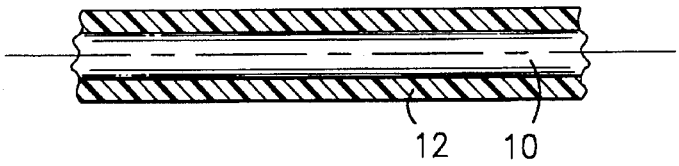
FIG. 1B is similar to FIG. 1A showing in addition, a melt adhesive applied to the lead or core stick in accordance with the process of the present invention.

In step a) of the process, the FIG. 1A shows a lead or core stick 10 of which only a portion is shown. FIG. 1B representing step b) shows the lead or core stick 10 to which a layer 12 of a fusion or melt adhesive has been applied. That can be effected for example by the lead or core stick 10 being dipped into a bath of a hot fusion or melt adhesive, or by a hot fusion or melt adhesive being applied to the lead or core stick 10 by spraying, painting, rolling or the like. The lead or core stick 10 may be a finished writing lead or a cosmetic powder core stick or the like. At any event this is a lead or core stick 10 comprising a non-melting material.

Figure 1C:
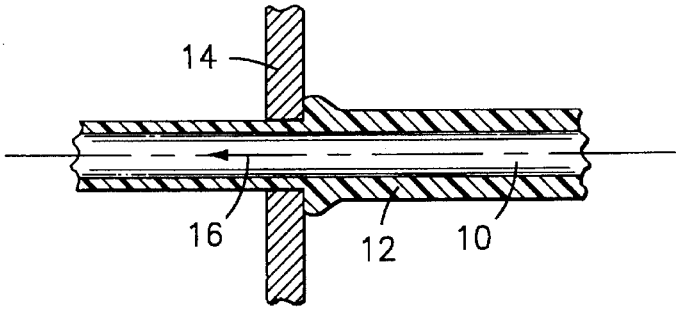
FIG. 1C is a partial cross-sectional view of the lead or core stick of FIG. 1B having an adhesive layer thereon and being moved through a calibration nozzle in accordance with the process of the present invention.

FIG. 1C representing step c) in the process shows a calibration nozzle 14 through which the lead or core stick 10 which is covered with the layer 12 of fusion or melt adhesive is moved, as indicated by the arrow 16. Excess adhesive material is removed from the lead or core stick 10 by means of the calibration nozzle 14 so that downstream of the calibration nozzle 14, the result is a lead or core stick 10 to which a precisely defined amount of adhesive material clings and which is of a defined outside diameter.

Figure 1D:
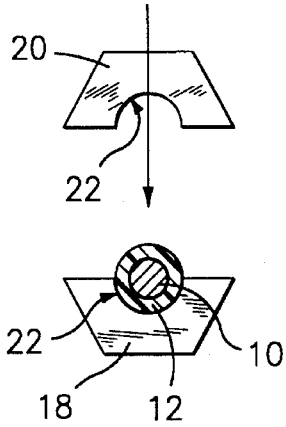
FIG. 1D is an end view of the assembly of a pencil including the lead or core stick of FIG. 1C formed in accordance with the process of the present invention.

FIG. 1D represents step d) of the process which is intended to illustrate the introduction into a first housing portion 18 of the lead or core stick 10 which is covered with the precisely defined layer 12 of adhesive, and the application of a second housing portion 20 to the first housing portion 18 which is fitted with the lead or core stick 10. Each of the two housing portions 18, 20 is provided with a groove 22 serving to receive the lead or core stick 10 which is covered with the adhesive 12.

Step d) of the process shows housing portions 18 and 20 of a finished pencil, but it has been found desirable if, instead of such housing portions, the process uses boards of a suitable shape, having a plurality of grooves 22 which are disposed in mutually parallel juxtaposed relationship.

The lead or core stick 10 can be fixed between the two housing portions 18 and 20 by means of microwave radiation. The housing portions 18 and 20 can be glued together by a per se known glueing procedure.

I claim:

1. A process for the production of a pencil, comprising the steps of:

introducing one of a lead and core stick into a groove in a first housing portion;

applying a second housing porting having a groove to the first housing portion wherein the groove of the second housing portion is fitted with one of said lead and said core stick; and gluing one of said lead and said core stick to said first and second housing portions; and gluing said first and second housing portions together;

wherein said step of gluing one of said lead and said core stick is achieved through using an adhesive comprising one of a flexible fusion adhesive and a melt adhesive, the adhesive having outside dimensions lying within close dimensional tolerances with respect to the dimensions of said grooves of said first and second housing such that one of said lead and said core stick is closely fixed between said first and second housing portions.

2. The process according to claim 1, further comprising the steps of:

introducing one of said lead and said core stick into a bath of said adhesive for covering one of said lead and said core stick with a layer of said adhesive; and moving one of said lead and said core stick covered with said adhesive through a calibration nozzle for acquiring said close dimensional tolerances.

3. The process according to claim 2, wherein said step of moving one of said lead and said core stick through said calibration nozzle is performed immediately after one of said lead and said core stick is moved through said bath.

4. The process according to claim 2, wherein said step of applying is performed upstream of said calibration nozzle and said step of moving is performed simultaneously to said step of applying.

5. The process according to claim 1, further comprising the step of fixing one of said lead and said core stick between the first and second housing portion by means of microwave radiation.

6. The process according to claim 2, wherein said step of moving includes the step of precisely defining the amount of said adhesive applied to one of said lead and said core stick along the length of one of said lead and said core stick and in accordance with the dimensions of said groove, such that as the dimensions of said grooves change along the length thereof, the dimensions of the adhesive applied to one of said lead and said core stick similarly change to achieve said close dimensional tolerances.

* * * * *